US006409047B1

(12) United States Patent
Tanaka

(10) Patent No.: US 6,409,047 B1
(45) Date of Patent: Jun. 25, 2002

(54) TUBE SQUEEZER

(76) Inventor: Mamoru Tanaka, 175 W. 72nd St., #4H, New York, NY (US) 10023

( * ) Notice: Subject to any disclaimer, the term of this patent is extended or adjusted under 35 U.S.C. 154(b) by 0 days.

(21) Appl. No.: 09/874,584

(22) Filed: Jun. 5, 2001

(51) Int. Cl.[7] ..... B65D 35/32

(52) U.S. Cl. ..... 222/99; 222/92; 222/103; 222/106

(58) Field of Search ..... 222/99, 92, 101, 222/103, 106, 104

(56) References Cited

U.S. PATENT DOCUMENTS

| | | | | | |
|---|---|---|---|---|---|
| 2,035,713 | A | * | 3/1936 | McMackin | 221/60 |
| 2,531,060 | A | * | 11/1950 | Krueger | 222/99 |
| 2,545,773 | A | * | 3/1951 | Gonzalez | 222/99 |
| 4,576,314 | A | * | 3/1986 | Elias et al. | 222/97 |
| 4,664,293 | A | * | 5/1987 | Sheppard | 222/99 |
| D303,892 | S | * | 10/1989 | Parker | D6/541 |
| 5,058,771 | A | * | 10/1991 | Curtis | 222/99 |
| 5,094,362 | A | * | 3/1992 | Dickens | 222/99 |
| D335,992 | S | * | 6/1993 | Planchon | D6/541 |
| 5,884,812 | A | | 3/1999 | Stawowski | |
| 5,975,361 | A | * | 11/1999 | Corrow | 222/99 |
| 6,189,737 | B1 | * | 2/2001 | Condon | 222/103 |

FOREIGN PATENT DOCUMENTS

| | | | | |
|---|---|---|---|---|
| DE | 3515647 A1 | * | 8/1986 | B65D/35/32 |
| GB | EP-0047447 A1 | * | 3/1982 | B65D/35/32 |
| GB | 2153329 A | * | 8/1985 | B65D/35/32 |

* cited by examiner

*Primary Examiner*—William C Doerrler
*Assistant Examiner*—Frederick Nicolas
(74) *Attorney, Agent, or Firm*—Dann, Dorfman, Herrell & Skillman, P.C.

(57) ABSTRACT

A tube squeezer having a simple and small-sized structure, which can squeeze out the content material out of a tube effectively, and surely maintain the squeezed state of the tube. This tube squeezer comprises, a tube having a closed one end along a length direction and another end from which a material contained therein can be discharged; a frame mounted integrally on one end of the tube along a width direction for holding the end of the tube; and a handle having a main body mounted on the frame and an arm extending from the main body. The main body projects from the tube in the width direction, so that a user can hold the main body when rolling up the tube by the frame. The arm extends from the main body such that a tip end portion thereof overlaps with a part of the tube, thus the tip end portion can be engaged with the surface of the tube when the tube is rolled up. Therefore, this tube squeezer makes it possible to prevent the reversed rotation of the rolled tube.

8 Claims, 4 Drawing Sheets

II–II

TUBE SQUEEZER

BACKGROUND OF THE INVENTION

The present invention relates to a tube squeezer which is used for squeezing out a material contained in a tube including tooth paste, cosmetic products of various kinds, chemical products and the like.

Conventionally, it is known that there is a tube squeezer for squeezing out the material contained in a tube.

For example, U.S. Pat. No. 5,884,812 discloses a type of tube squeezer which squeezes out the contents by the following manner. First, the lower end portion of the tube is inserted into a slit of a rotation shaft contained within a housing. The lower end portion of the tube is mounted on the rotation shaft within the housing so that it curls as a key provided on one side of the rotation shaft is rotated.

However, with the above-described structure, not only is the size of the squeezer large, taking up a lot of space, but the tube being rolled up may be released if the key is released. In order to avoid this, the user must hold the key so that the shaft will not rotate in reverse. Otherwise, the user would be required to roll up the tube each time the tube is used.

BRIEF SUMMARY OF THE INVENTION

The present invention has been proposed in consideration of the above-described drawback of the conventional technique.Its main objective is to provide a tube squeezer having a simple and small-sized structure, which can squeeze out the content material out of a tube effectively, while surely maintaining the squeezed state of the tube.

In order to achieve the above-described objective, the present invention comprises: a tube squeezer comprising a tube having a closed one end along a length direction, and another end from which a material contained therein can be discharged; a frame mounted integrally on one end of the tube along a width direction for holding the one end of the tube; and a handle having a main body mounted on the frame and an arm extending from the main body, wherein the main body projects from the tube in the width direction, so that a user can hold the main body when rolling up the tube by the frame, and the arm extends from the main body such that the tip end portion thereof overlaps with a part of the tube, thus the tip end portion can be engaged with the surface of the tube when the tube is rolled up, thereby making it possible to prevent the reversed rotation of the rolled tube.

With the above-described structure, the squeezer can be made as an integral unit with a tube, thereby reducing the overall size. Furthermore, if the tip end portion of the arm unit is hooked on the tube after the tube is rolled up, the reversed rolling-up effect of the tube can be prevented. It should be noted that the frame may be prepared as a separate part from the tube or they may be one integral unit.

According to one embodiment of the present invention, the main body of the handle is mounted on the frame in a direction in which an overlap section between the arm and the tube increases. Here, it is preferable that the arm of the handle should be formed such that its tip end portion abuts vertically onto the surface of the tube when the handle is rotated.

With the above-described structure, as the tip end portion of the arm is rotated, the tube can be pinched between the tip end portion and the frame to be held.

According to another embodiment of the present invention structure, there are two arms provided for the handle, and these arms extend from the respective positions to be symmetrical with respect to the frame of the main body. With this structure, when the handle is rotated so as to allow the tip end portion of one of the arms to abut the surface of the tube, the end of the other arm moves outward from the edge of the tube. Here, it is preferable that the handle should be set in such a state that the tip end portion of one arm overlaps with a part of the tube while the handle is situated in a neutral position.

With the above-described structure, the two arms are formed to be line-symmetrical with respect to the frame while interposing the frame between them. Therefore, the rolling-up of the tube and the engagement between the tube and the tip end portion of the arm can be done similarly with either one of the arms. Further, when the tube is rolled up, one of the two arms is rotated to such a position that its tip end portions abuts the surface of the tube. In this manner, the other arm does not interfere with the tube, and therefore the rolling up operation can be further facilitated.

Additional objectives and advantages of the invention will be set forth in the description which follows, and in part will be obvious from the description, or may be learned by practice of the invention.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to accompanying drawings.

Figure 1:
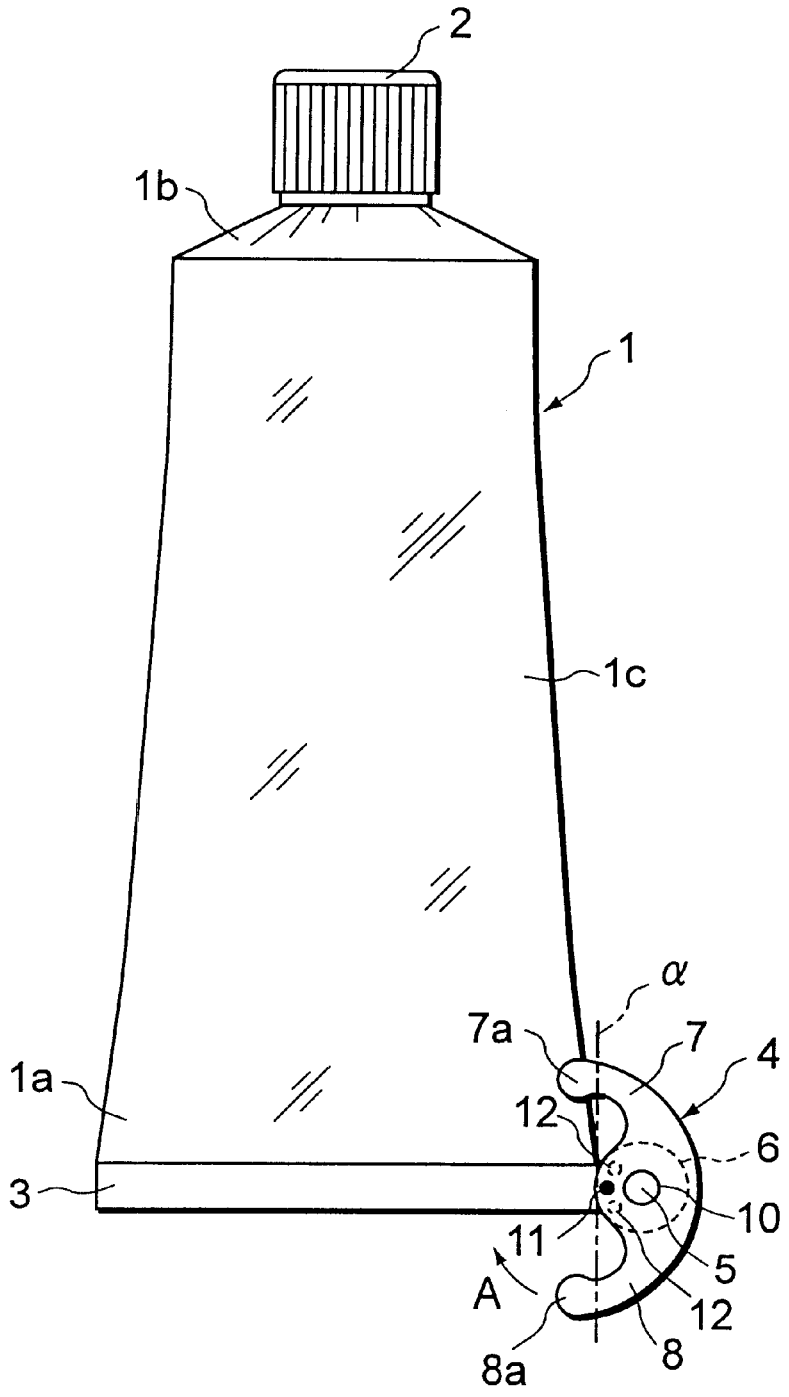
FIG. 1 is a diagram illustrating a front view of a plastic-made (polypropylene-made) tube equipped with a squeezer.

FIG. 1 is a front view of a tube equipped with a squeezer, according to an embodiment of the present invention.

The tube 1 has one end portion 1*a* in its longitudinal direction, which is closed by pressing down, whereas another end 1*b* of the tube is provided with a discharge opening 2 with a cap, for discharging a material contained in the tube 1, for example, toothpaste. In order to discharge the toothpaste from the discharge opening 2, a body portion 1*c* of the tube must be squeezed from the side of the one end portion 1*a*. This type of tube 1 may be made of a poly-foil-poly structure that has polyethylene on either side of a thin gauge of foil. However, the present invention is not limited to this tube material, but it may be used with other materials such as metal, lead, tin or, more often, aluminum.

For squeezing the tube 1, a band plate-shaped frame 3 is provided on the one end portion 1*a* of the tube 1, to be arranged along the width direction of the tube 1 and fixed such as to pinch the one end portion 1*a*. Further, a handle 4 designed to roll up the body portion 1*c* of the tube 1 thereby squeezing the tube 1 is provided for the frame 3.

The handle 4 further includes a main body 6 mounted on one end of the frame 3 by means of a center shaft 5, and a pair of arms 7 and 8 extending out from the main body 6. The main body 6 projects outwards in the width direction of the tube 1, and is situated such that the user can hold it when the tube 1 is rolled up on the frame 3 for squeezing it. The pair of arms 7 and 8 extends out from the main body 6 in opposite directions along the length direction of the tube 1. Further, the arms 7 and 8 are formed such that the respective tip end portions 7*a* and 8*a* of the arms 7 and 8 are bent toward the tube 1 so that they protrude beyond a line (indicated by reference symbol $\alpha$ in the FIG. 1) taken along the side portion of the tube 1 when the handle 4 is set in a neutral state as shown in FIG. 1.

Figure 2A:
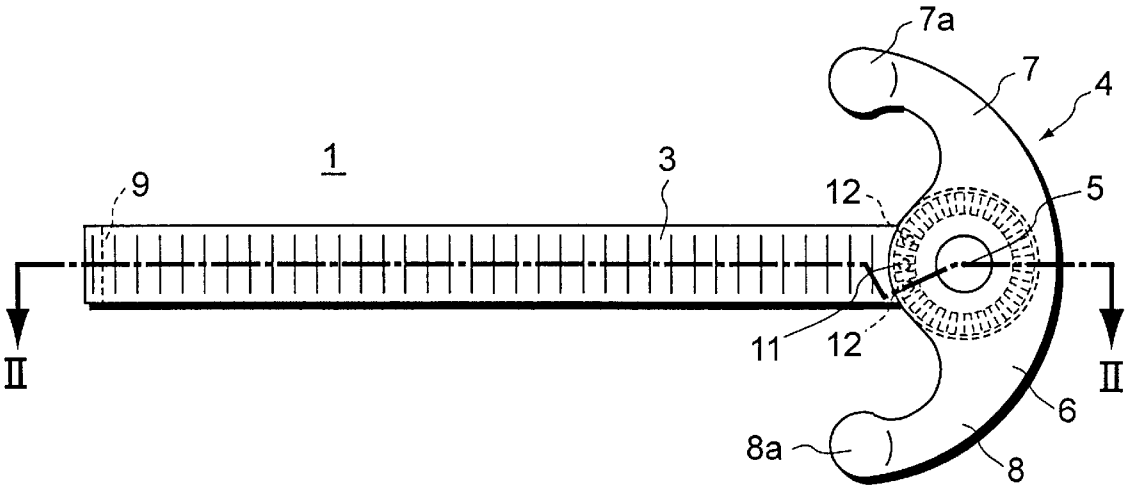
FIGS. 2A and 2B are diagrams of enlarged front view of a frame and a handle, and an enlarged lateral cross section thereof, respectively.
Figure 2B:
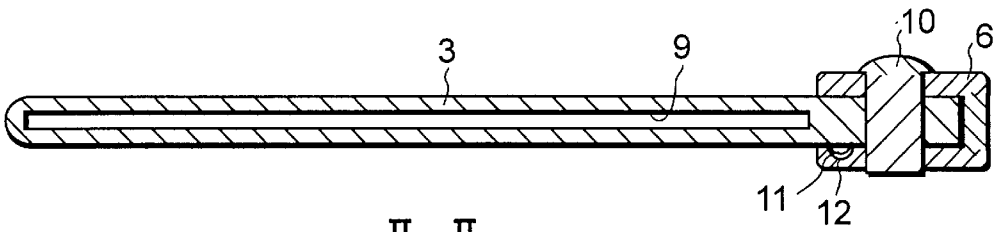

FIG. 2A is a diagram of an enlarged front view of a frame and a handle, and FIG. 2B is an enlarged lateral cross section of what is shown in FIG. 2A taken along a line II—II.

As shown in FIGS. 2A and 2B, the frame 3 is an integrated mold product having a slit 9 at its central portion in the thickness direction, for pinching the one end portion 1*a* of the tube 1 into the slit 9. (See FIG. 1.) The frame 3 is attached to the tube 1 while the one end portion 1*a* of the tube 1 is pinched into the slit 9. It should be noted that in the case where the tube 1 is made of a metal, and the one end portion 1*a* thereof is closed by caulking, the caulking may be performed while the one end portion 1*a* of the tube 1 is rolled into the slit 9.

Further, the main body 6 of the handle 4 is mounted with a plastic rivet 10 while one end portion of the frame 3 is pinched in the main body 6 as can be seen in FIG. 2B. Further, a projection 11 is made on the surface of the frame 3 and recesses 12 which can engage with the projection 11 are provided in the main body 6 of the handle 4. With this structure, the rotation position of the frame 3 can be regulated. More specifically, there are a total of two recesses 12 at positions indicated by a dotted line in FIG. 2A. With this structure, one recess 12 is used to lock the movement of the handle 4 when one of the arms 7 is used, and the other recess 12 is used similarly for the other arm 8 at respective positions.

Next, the operation of squeezing the tube 1 will be described with reference to FIG. 3.

Figure 3:
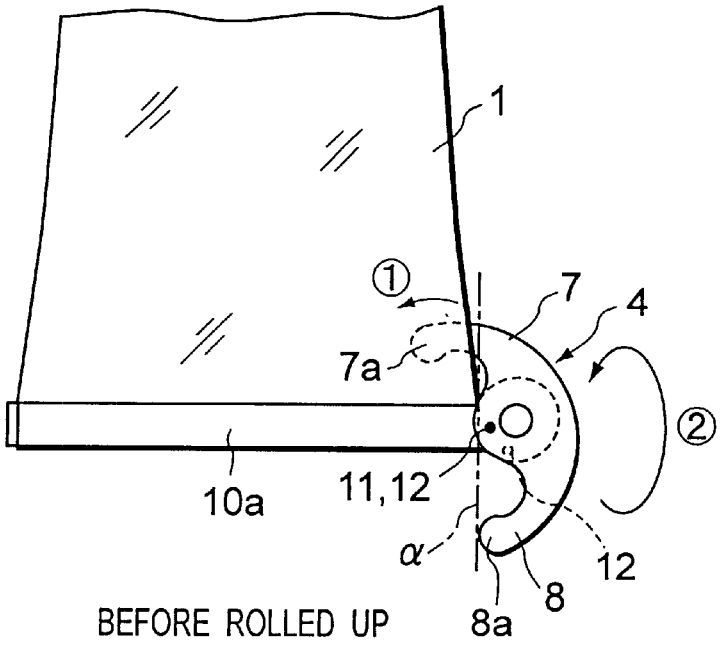
FIG. 3 is a diagram illustrating how to operate the handle for rolling up a tube.

First, when a user squeezes the tube 1 for the first time, he or she rotates the handle 4 from the state shown in FIG. 1 in the direction indicated by an arrow ① in FIG. 3 until the projection 11 and the recess 12 engage. Here, it is preferable that the tip end portion 7*a* of one of the arms 7 should be put in the rear side of the tube 1. At this point, the tip end portion 8*a* of the other arm 8 is designed to protrude outwards from the line a taken along the side portion of the tube 1. With this structure, it is possible to prevent the other arm 8 from being caught by the tube 1 when the user is rolling up the tube 1 while holding the handle 4.

Figure 4:
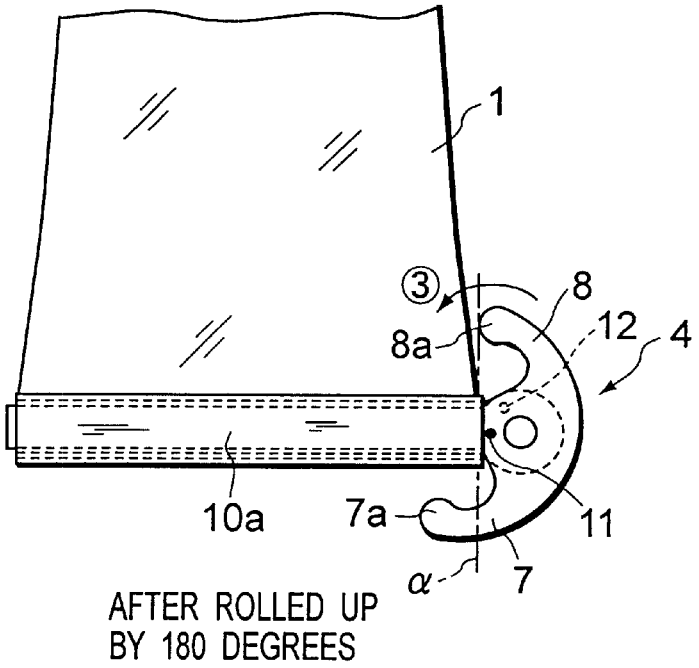
FIG. 4 is a diagram illustrating how to operate the handle after the tube is rolled up.
Figure 5:
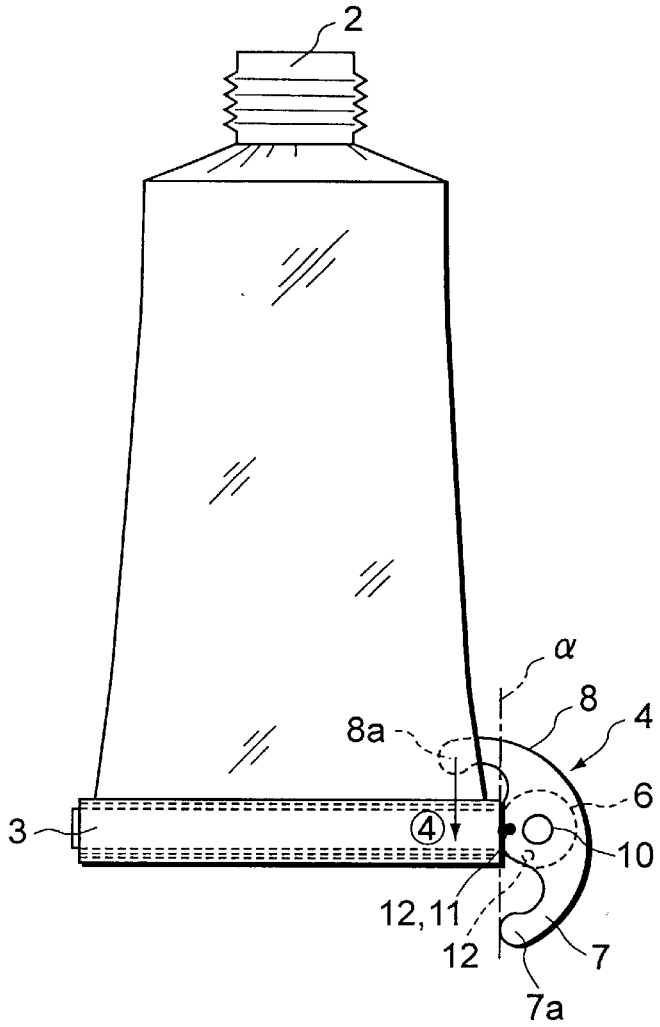
FIG. 5 is a diagram showing a front view of the tube when rolled up.

FIG. 4 shows a state where the tube 1 is rolled up further by rotating the handle by an angle of 180 degrees from the state shown in FIG. 3 in the direction indicated by an arrow ②. In order to prevent the rolled-up state of the tube 1 from being released, the user rotates the handle 4 in the direction indicated by an arrow ③ in FIG. 4, and puts the tip end portion 8*a* of the other arm 8 in the rear side of the tube 1 as shown in FIG. 5.

Figure 6:
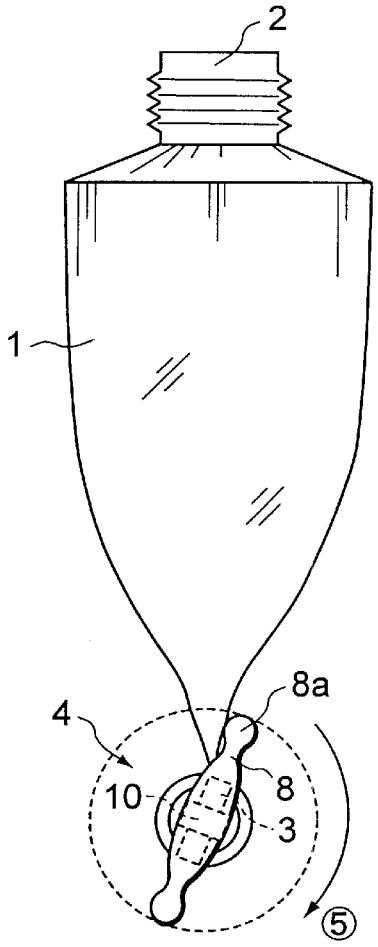
FIG. 6 is a diagram showing a side view of the tube when rolled up.

FIG. 6 illustrates the above-described state as it is viewed from a lateral side. As shown in FIG. 6, this figure, each of the tip end portions 7*a* and 8*a* of the arm portions 7 and 8 form ball shapes, and the entire outer portion is made into a curvature surface. With such a spherical shape, it is possible to sandwich the tube 1 between the tip end portion 8*a* of the arm 8 and the frame. 3 while keeping the tip end portion 8*a* sliding on the surface of the tube 1. In this manner, the tube 1 is never damaged.

Further, the tip end portions 7*a* and 8*a* of the arms 7 and 8 are formed slightly bent towards the frame 3 in a hook-like shape, and their outer surfaces are formed to have curvatures. With this structure, as shown in FIG. 5, when the tip end portion 7*a* of the arm 7 is allowed to abut the surface of the tube 1 by rotating the handle 4, the surface of the tube 1 can be pressurized substantially with respect to the frame 3 as indicated by an arrow ④ in the figure. In this manner, the pressure force applied to this section can be increased, thereby making it possible to prevent the rolled-up state of the tube 1 from being released.

Then, as the handle 4 is rotated until the projection 11 engages with the recess 12 to lock, the tube 1 can be maintained in such a state as shown in FIG. 6.

In the case where further squeezing is still required after the above-described squeezing operation, the handle 4 is held in the state shown in FIG. 6, and then rolled up by an angle of 180 degrees in the direction indicated by an arrow ⑤ in the FIG. 6. In this way, the tip end portion 7*a* of the arm 7 of the handle 4 is put on the rear side of the tube 1 as shown in FIG. 3, thereby locking the arm 7 while the tube 1 is being rolled up.

As the toothpaste is consumed, the above-described operation is repeated, and thus the toothpaste can be completely used up without wasting the paste.

It should be noted that the frame 3 and the handle 4 are each formed to have an optimum size for the shape and size of the tube 1, and therefore it is preferable that they should be provided as an integral unit set on the tube 1 as a product when actually merchandized in stores. However, in the case of the structure presented in FIG. 2A and FIG. 2B, the squeezer may be provided as a separate auxiliary product to the tube 1.

The present invention is not limited to the above-described embodiment, but it may be modified into various versions as long as the essence of the invention remains.

For example, in the above-described embodiment, there are two arms 7 and 8 provided for the handle 4; however it is possible to make it only one arm to reduce the overall size of the squeezer. In this case, the arm may be formed rotatable with respect to the main body 6. With this structure, as the arm is rotated towards the tube 1 by an angle of 180 degrees after the tube 1 is rolled up by the handle 4 for a certain amount, the tip end portion of the arm can be engaged with the side portion of the tube 1 as in the case of the embodiment described above. In addition, it is possible to adjust the amount of the content material discharged.

Further, in the above-described embodiment, the frame 3 is formed as a separate part from the tube 1; however it may be formed as an integral unit. For example, the one end portion 1*a* of the tube 1 may be formed to be thicker as compared to the body portion 1*c* so that it can be used also as a frame 3.

Moreover, the above-described embodiment is described in connection with the case where the tube 1 is a tube for tooth paste; however the present invention is not limited to this, and it may be a tube for an adhesive, for example.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A tube squeezer comprising:

a tube having a closed one end along a length direction, and another end from which a material contained therein can be discharged;

a frame mounted integrally on one end of the tube along a width direction, for holding the one end of the tube; and a handle having a main body mounted on the frame with two arms which extend out from the main body, each arm having a tip end portion which can abut vertically on a surface of the tube when the handle is rotated, wherein the main body projects outwards of the tube in the width direction, so that a user can hold the main body when rolling up the tube by the frame, and the arms extend from the main body such that a tip end portion of one arm overlaps with a part of the tube, thus the tip end portion can be engaged with a surface of the tube when the tube is rolled up to prevent the reverse of the rolled tube and the main body is adapted to be rotated in a direction where an overlapping section between one arm and the tube increases, whereby when the handle is rotated so that the tip end portion of one of the arms abuts on the surface of the tube, the tip end portion of the other arm moves outwards from a line along an outer side of the tube.

2. A tube squeezer according to claim 1, wherein when the handle is in a neutral state, the tip end portion of one of the arms engages with a part of the tube.

3. A tube squeezer according to claim 1, wherein the tip end portion of the arms each are made spherical.

4. A tube squeezer according to claim 1, wherein the tip end portion of the arms is each formed to extend toward the frame.

5. A tube squeezer according to claim 1, wherein engagement means is formed on an abut portion between the main body of the handle and the frame, and the handle is locked by means of the engagement means.

6. A tube squeezer comprising:

a frame having a portion adapted to be mounted on the end of a tube along a width direction, for holding the one end of the tube; and a handle having a main body rotatably mounted on the frame and having at least one arm extending outwardly from the main body, the arm having a tip end portion;

wherein a user can hold the main body when rolling up the tube by the frame, and the arm extends from the main body such that the tip end portion of the arm is rotatable to engage with a part of the tube, when the tube is being rolled up, to prevent the tube from unrolling.

7. A tube squeezer comprising:

a tube having a closed end along a length direction and an open end from which a material contained therein can be discharged;

a frame having a portion mounted integrally on the closed end of the tube, for holding the closed end of the tube; and a handle having a main body rotatably mounted on the frame spaced from the portion mounted on the tube, the handle having two arms extending symmetrically outwardly from the main body on opposite sides, whereby a user can hold the handle and rotate the handle when rolling up the tube by the frame, and when the handle is rotated a tip end portion of one of the arms overlaps with a part of the tube, and the main body configured to rotate in a direction so as to increase the overlap between the tip end portion of the first arm and the part of the tube and move a tip end portion of the second arm outwards from a line along an outer side of the tube, whereby so that the tip end portion of the one arm can be engaged with a surface of the tube to prevent the tube from unrolling.

8. A tube squeezer adapted to squeeze a tube comprising:

a frame having a portion adopted to be mounted on one end of the tube, for holding the one end of the tube; and a handle rotatably mounted on the frame spaced from the portion of the frame mounted on the tube, the handle having a main body and two arms extending out from the main body on opposite sides, each arm having a tip end portion, whereby a user can hold the handle and rotate the handle when rolling up the tube by the frame and when the handle is rotated a tip end portion of one of the arms overlaps with a part of the tube so that the tip end portion of the one arm can be engaged with a surface on the tube to prevent the tube from unrolling.

* * * * *